United States Patent [19]

Remington

[11] 4,366,685

[45] Jan. 4, 1983

[54] LATCHING ASSEMBLY FOR LUGGAGE AND THE LIKE

[75] Inventor: Richard C. Remington, Pompton Plains, N.J.

[73] Assignee: Presto Lock, Inc., Garfield, N.J.

[21] Appl. No.: 195,366

[22] Filed: Oct. 9, 1980

[51] Int. Cl.[3] ..... E05B 37/02

[52] U.S. Cl. ..... 70/70; 70/312

[58] Field of Search ..... 70/67, 69, 70, 71, 312; 292/25, 26, 30, 45, 46, 47, 29, 48, 53, 121, 122

[56] References Cited

U.S. PATENT DOCUMENTS

| | | | |
|---|---|---|---|
| 319,207 | 6/1885 | Doolittle . | |
| 928,904 | 7/1909 | Cottrell . | |
| 1,112,706 | 2/1914 | Koch . | |
| 1,170,697 | 2/1916 | Stallings . | |
| 1,593,226 | 7/1926 | Stuart . | |
| 1,604,983 | 11/1926 | Ferguson | 70/256 |
| 2,238,480 | 4/1941 | Tierney | 292/28 |
| 2,440,595 | 4/1948 | Smith | 292/25 |
| 2,916,317 | 12/1959 | Diday | 292/26 |
| 3,204,436 | 9/1965 | Nemsky | 70/63 |
| 3,545,238 | 12/1970 | Gehrie | 70/76 |
| 3,695,072 | 10/1972 | Milette | 70/312 |
| 3,961,505 | 6/1976 | Gehrie et al. | 70/66 |
| 4,068,871 | 1/1978 | Mercer | 292/48 |
| 4,281,525 | 8/1981 | Bako | 70/312 |

FOREIGN PATENT DOCUMENTS

| | | | |
|---|---|---|---|
| 850670 | 9/1939 | France | 292/30 |

*Primary Examiner*—Robert L. Wolfe

*Attorney, Agent, or Firm*—Shapiro and Shapiro

[57] ABSTRACT

A latching assembly for luggage cases and the like includes a pair of spaced latches pivotally mounted on a base attached to the interior surface of a first part of a luggage case, the latches being cooperable with associated hasps mounted on a second part of the case for holding the case closed. A slideable actuator is mounted on the exterior surface of the first part of the case and associated with one of the latches for moving the latch to unlatching position. An elongated member extending between the latches constrains the latches for concerted pivotal movement between latching and unlatching positions. A combination lock may also be included for controlling the movement of the actuator necessary to open the case.

32 Claims, 7 Drawing Figures

LATCHING ASSEMBLY FOR LUGGAGE AND THE LIKE

BACKGROUND OF THE INVENTION

The present invention relates generally to latching assemblies or consoles for luggage cases and the like.

Latching assemblies are known in which two or more spaced latches, assembled in a console adapted to be attached to a first part of a luggage case, are interconnected by control members to enable the latches to be operated by a single actuator, or to enable the latches to be locked by a single combination lock. Such assemblies are convenient for opening, closing and locking of the case. However, known latching assemblies have several difficulties. They tend to have a complicated structure and require that rather close tolerances be maintained between the various elements of the assembly in order to ensure proper operation. They are not readily adaptable to different types of luggage cases, but, rather, generally must be specifically tailored to the particular type of case on which they are to be used. For example, since the latches, actuators, combination lock, etc., are usually related to the exterior surface of a luggage case, whereas the control mechanism is mounted on an interior surface of the luggage case, it is necessary to take into account side wall thickness, valance construction, and case configuration in designing a latching assembly. Moreover, normal variations in dimensions, such as side wall thicknesses, between individual cases of a particular type can lead to mounting difficulties or contribute to poor or improper operation of the latching assembly.

SUMMARY OF THE INVENTION

The invention provides latching assemblies which overcome the above-mentioned and other disadvantages of known latching assemblies. Latching assemblies in accordance with the invention are easily adaptable to luggage cases of widely varying constructions, dimensions, and configurations. The latching assemblies do not require the maintenance of close tolerances and are not affected by the normal dimensional variations encountered between individual cases of the same type. They have a relatively simple construction, requiring only a few parts and being easily assembled, and the number of parts which must be mounted on the exterior of the case is minimized. Accordingly, they permit luggage cases having a modern, uncluttered appearance.

Briefly stated, in accordance with one aspect, a latching assembly in accordance with the invention comprises a pair of spaced pivoting latches adapted to be mounted on a first part of a luggage case adjacent to an edge thereof. The latches are movable between latching and unlatching positions and are cooperable with associated hasps on a second part of the case for holding the case closed when the parts are brought together and the latches are in latching position. An actuator is adapted to be slideably mounted on the first part of the case for movement between a rest position and an open position, the actuator being associated with one of the latches for moving the latch to unlatching position when the actuator moves to open position. An elongated member extends between the latches so that the latches are constrained for concerted movement between latching and unlatching positions.

In accordance with another aspect, the latching assembly comprises latch means adapted to be pivotally mounted on a first part of a luggage case adjacent to an edge thereof, the latch means being movable between latching and unlatching positions and being cooperable with associated hasp means on a second part of the case to hold the case closed, and combination lock means adapted to be mounted on the first part of the case. The combination lock means has a slideable actuator movable from a rest position to an open position when the combination lock means is on combination. The actuator has means for engaging the latch means to move the latch means to unlatching position when the actuator moves to open position.

In accordance with yet another aspect, the latching assembly comprises latch means adapted to be pivotally mounted on a first part of a luggage case adjacent to an edge of the case and being movable between latching and unlatching positions in a plane parallel to the plane containing the first part of the case and the edge. Actuator means adapted to be slideably mounted on the first part of the case for movement between a rest position and an open position is related to the latch means so that the actuator means moves the latch means to unlatching position when the actuator moves to open position. Combination lock means is included for preventing movement of the actuator from its rest position, except when the combination lock means is on combination.

In accordance with still another aspect, the latching assembly comprises latch means pivotally mounted on a first part of the luggage case for movement between latching and unlatching positions and hasp means mounted on a second part of the luggage case and being cooperable with the latch means for holding the case closed, the latch means and the hasp means being mounted on the interior of the case so that they are hidden from view when the case is closed. A control panel including a slideable actuator movable between a rest position and an open position and a combination lock for controlling the movement of the actuator is asymmetrically mounted on the exterior of the luggage case. Means are provided on the interior of the luggage case for moving the latch means to unlatching position when the actuator moves to open position.

The invention further provides, for use in a latching assembly of the type having a pivoted latch mounted on a first part of a luggage case for movement between latching and unlatching positions and being cooperable with an associated hasp on a second part of the luggage case for holding the case closed, a latch comprising a generally planar elongated member having means for pivotally mounting the member on the luggage case for rotation about an axis substantially perpendicular to the plane of the member. The member has first and second portions extending in opposite directions from the pivoting means and a recess located within each of the portions between the pivoting means and an end of the member. Each recess is connected to one side of the member by an opening, and a hook element is formed near the end of the first portion of the member for engaging the associated hasp.

DESCRIPTION OF THE PREFERRED EMBODIMENT

The latching assembly of the invention is primarily intended for use with luggage cases and similar articles and will be described in that context, although as will become apparent from the following description, it has a much wider applicability.

Figure 1:
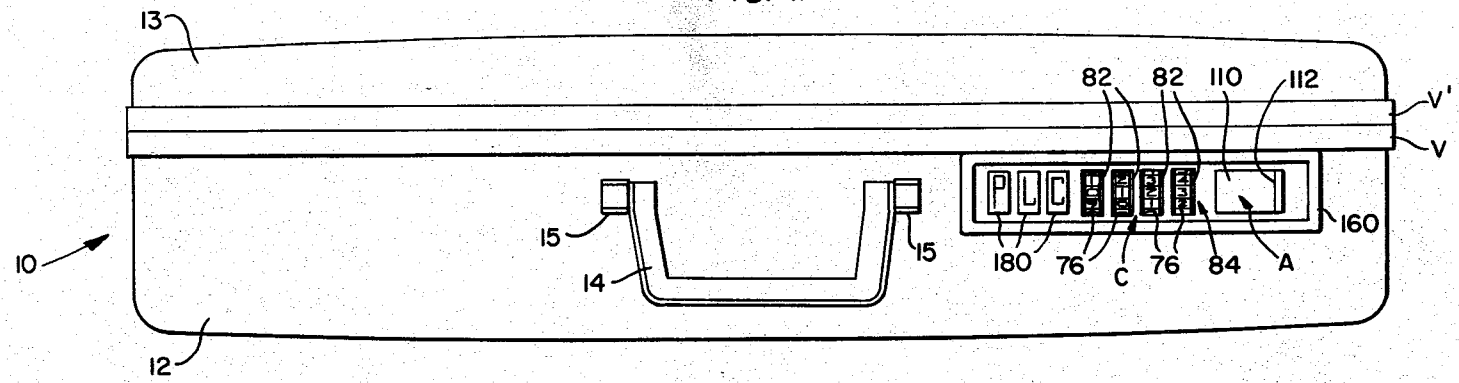
FIG. 1 is a top view of a luggage case employing a latching assembly in accordance with the invention.

FIG. 1 is an overall view of a luggage case 10 employing a latching assembly in accordance with the invention. As shown, the luggage case has a body 12 and a lid 13 with valance members V, V' attached to the mating edges of the body and the lid, respectively, and a carrying handle 14, which may be pivotally mounted on the body by handle studs 15 in a well-known manner. From FIG. 1, it may be noted that the latches normally found on opposite sides of the handle of a luggage case are conspicuously absent. Instead, as will be described in detail hereinafter, the latching assembly of the invention employs latches which are mounted on the interior surface of the case and which are controlled by a single actuator A positioned on the exterior surface of the case and associated with one of the latches. The latching assembly of the invention may also employ a combination lock C, as shown in the preferred form of the invention illustrated in the drawings, for locking the case. Accordingly, as shown in FIG. 1, a luggage case employing the latching assembly of the invention may have a very distinctive, modern, and uncluttered appearance.

Figure 2:
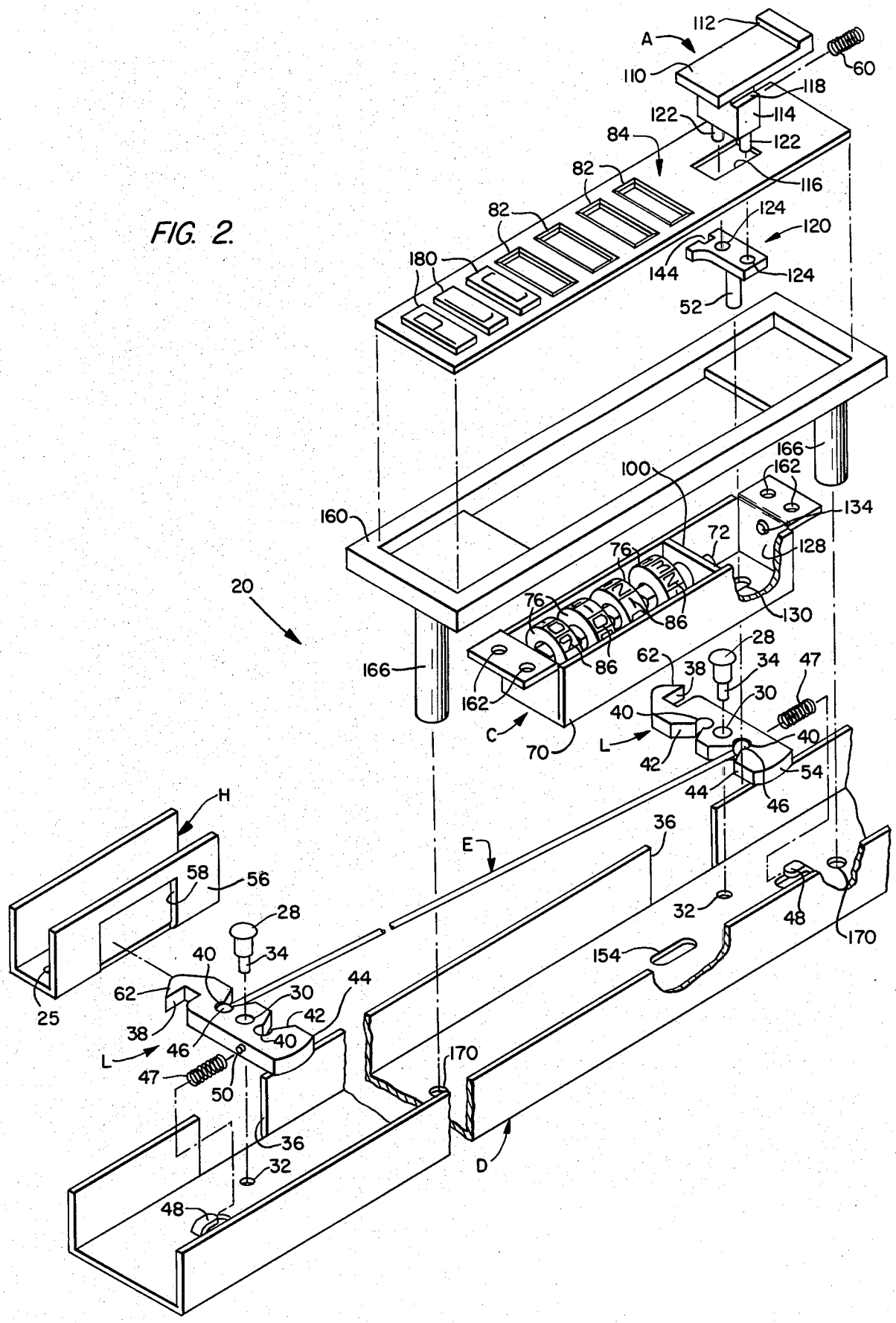
FIG. 2 is an exploded perspective view of a latching assembly in accordance with the invention.

FIG. 2 illustrates a preferred form of a latching assembly 20 in accordance with the invention. As shown, and as will be described in detail hereinafter, the latching assembly generally comprises an elongated base member or channel D, a pair of spaced latches L pivotally mounted on the channel and cooperable with associated hasps H (only one hasp being illustrated in FIG. 2) and an actuator A associated with one of the latches for moving the latches to unlatching positions. The latches are interconnected by an elongated member E so that they are constrained for concerted pivotal movement in the plane of the channel. As previously indicated, the latching assembly may also include a combination lock C, which in the form illustrated prevents the required movement of actuator A for moving the latches to unlatching position to open the case, except when the combination lock is on combination.

Channel D, which may be a generally U-shaped aluminum extrusion as shown, is adapted to be mounted on the interior surface of a first part, e.g., body 12, of a luggage case adjacent to and extending along the edge of the case. The hasps H, which may be generally U-shaped die cast members as shown, are adapted to be mounted on the interior wall of a second part, e.g., lid 13, of the luggage case and to be positioned so that they can be engaged by the latches when the latches are in latching position to hold the case closed.

Actuator A is adapted to be slideably mounted on the exterior surface of the first part of the luggage case adjacent to one of the latches (the right-hand latch in the embodiment illustrated in the figures) and engages the latch for moving it to unlatching position. By virtue of the elongated member E extending between the two latches, the movement of one latch produces a corresponding movement of the other latch.

Figure 5:
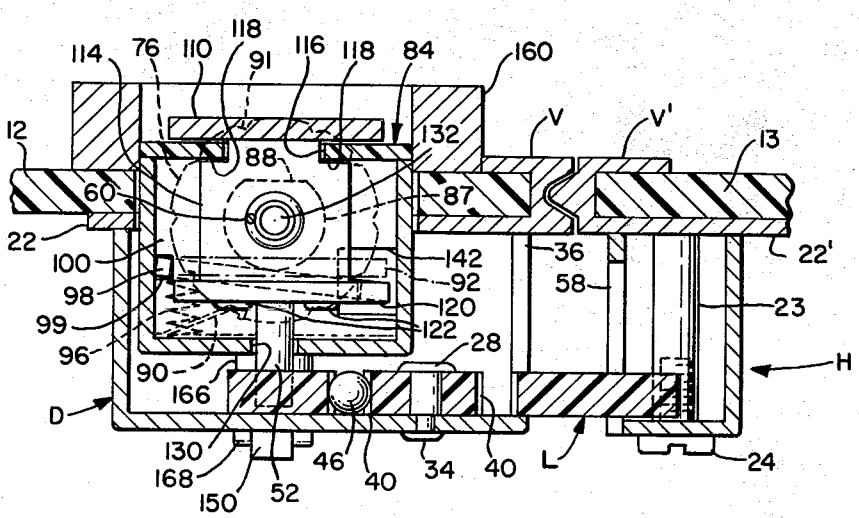
FIG. 5 is a transverse sectional view taken approximately along the line 5—5 of FIG. 4.

In greater detail now, the valance members V, V', attached to the edges of the body 12 and the lid 13, respectively, of the luggage case, are preferably formed with wide inner flanges 22, 22', respectively, as best illustrated in FIG. 5. Channel D and hasps H may be connected to the inner flanges in any conventional manner. For example, as illustrated in FIG. 5 for the connection of one hasp H to inner flange 22', the inner flanges may have depending studs 23 for receiving threaded fasteners 24 extending through aligned holes 25 (FIG. 3) in the hasp. Channel D may be attached to inner flanges 22 in the same manner. This method of attachment has the advantage that rivet heads are not visible on the exterior of the luggage case.

Latches L are preferably identical elongated planar members, thereby minimizing the number of different parts required, and are preferably formed of plastic with a shape best illustrated in FIG. 2. The latches are mounted for pivotal movement in the plane of the channel about parallel pivotal axes by shoulder rivets 28 extending through holes 30 in the latches and holes 32 in the channel. The ends 34 of the rivets passing through holes 32 may be swedged over (as illustrated in FIG. 5) to connect the rivets to the channel. Holes 30 are positioned at approximately the midpoints of the latches so that each latch is statically balanced about its pivotal axis (for a reason which will be explained shortly). One end of each latch extends through an opening 36 in the side wall of the channel adjacent to the lid of the case (and beyond the edge of the case when the channel is attached thereto) and is shaped to form a hook 38 for engaging an associated hasp H. Each latch also has a pair of holes or recesses 40 therein connected by sector-shaped openings 42 to one side 44 of the latch. Recesses 40 are preferably located equally distant from and on opposite sides of the pivotal axis of the latch with the sector-shaped openings 42 facing in the opposite direction from hook 38. One recess 40 of each latch is used for connecting the latch to elongated member E.

Elongated member E may be a flexible cable or a rod having an enlargement or a ball 46 fixed to each end thereof. Recesses 40 in the latches are sized to receive and to capture the enlargements 46. The sector-shaped openings 42 provide a passage for the elongated member to extend beween the latches and to be located within the plane of the latches, and allow the latches to rotate unobstructed by the elongated member.

As shown in FIG. 2, latches L are preferably mounted on the channel with their hooks 38 facing away from each other and with their sides 44 and sector-shaped openings 42 facing each other. The elongated member E is connected to the two latches on opposite sides of their respective pivot points (axes) and extends diagonally across an imaginary line connecting the pivotal axes of the two latches. As shown, the enlargement on the end of the elongated member which is connected to the left-hand latch is positioned within the recess 40 located between the pivotal axis (hole 30) of the left-hand latch and its hook 38, while the enlargement on the end of the elongated member connected to the right-hand latch is located in the recess 40 on the opposite side of the pivotal axis of the right-hand latch from its hook 38. Accordingly, the latches are constrained for pivotal movement in opposite directions. When the right-hand latch rotates counterclockwise to unlatching position (shown in phantom lines in FIG. 3) the elongated member causes the left-hand latch to rotate clockwise an equal amount to its unlatching position. The advantages of this arrangement will be explained shortly.

Figure 4:
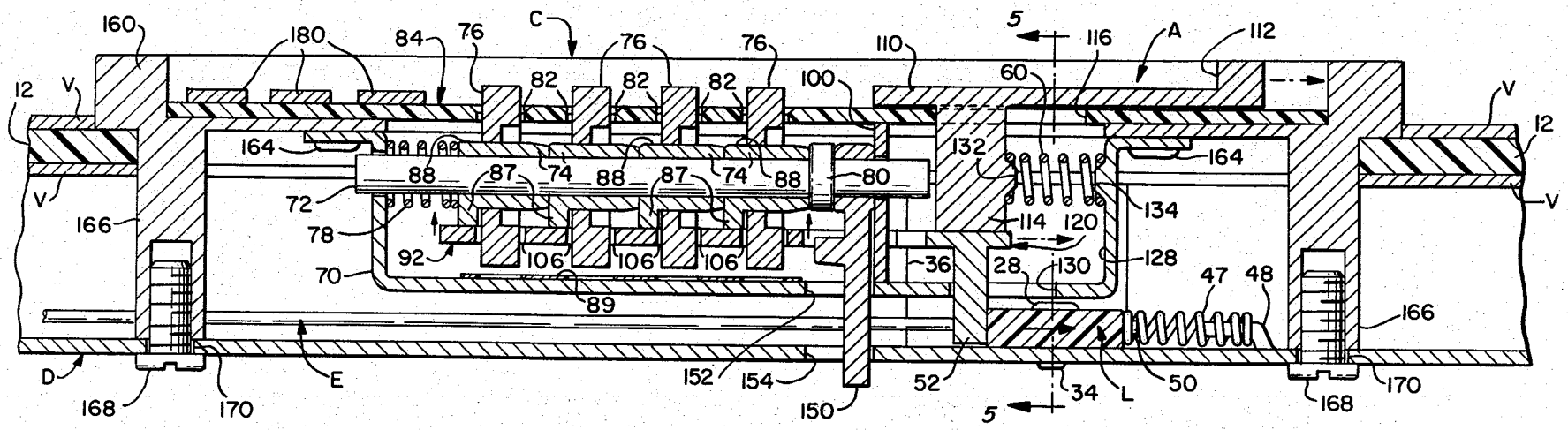
FIG. 4 is a longitudinal sectional view taken approximately along the line 4—4 of FIG. 3.

Preferably, spring means is provided for biasing each latch L toward its latching position. As shown in FIGS. 2 and 4, a coil spring 47 may be located on a tab 48 formed in the channel adjacent to each latch and may be located on a projection 50 formed on the adjacent side of each latch. Preferably, each coil spring engages its associated latch in the vicinity of the recess 40 located in the portion of the latch on the opposite side of its pivotal axis from the hook 38. The coil springs bias the latches in opposite directions, the right-hand latch being biased clockwise and the left-hand latch being biased counterclockwise. The coil springs serve to hold the latches in latching position and to return the latches to latching position when they are rotated to unlatching position by actuator A.

Actuator A is slideably mounted on the case adjacent to the right-hand latch, in a manner which will be explained later, and is movable parallel to the edge of the case between a rest position and an open position. As best illustrated in FIGS. 2, 4, and 5, the actuator has a depending projection 52 which engages side 44 of the right-hand latch between the sector-shaped opening of the recess receiving enlargement 46 of the elongated member E and the end 54 of the latch opposite to hook 38. In the solid-line positions illustrated in FIGS. 3 and 4, actuator A is in its rest position and the right-hand latch L is in its latching position.

Figure 3:
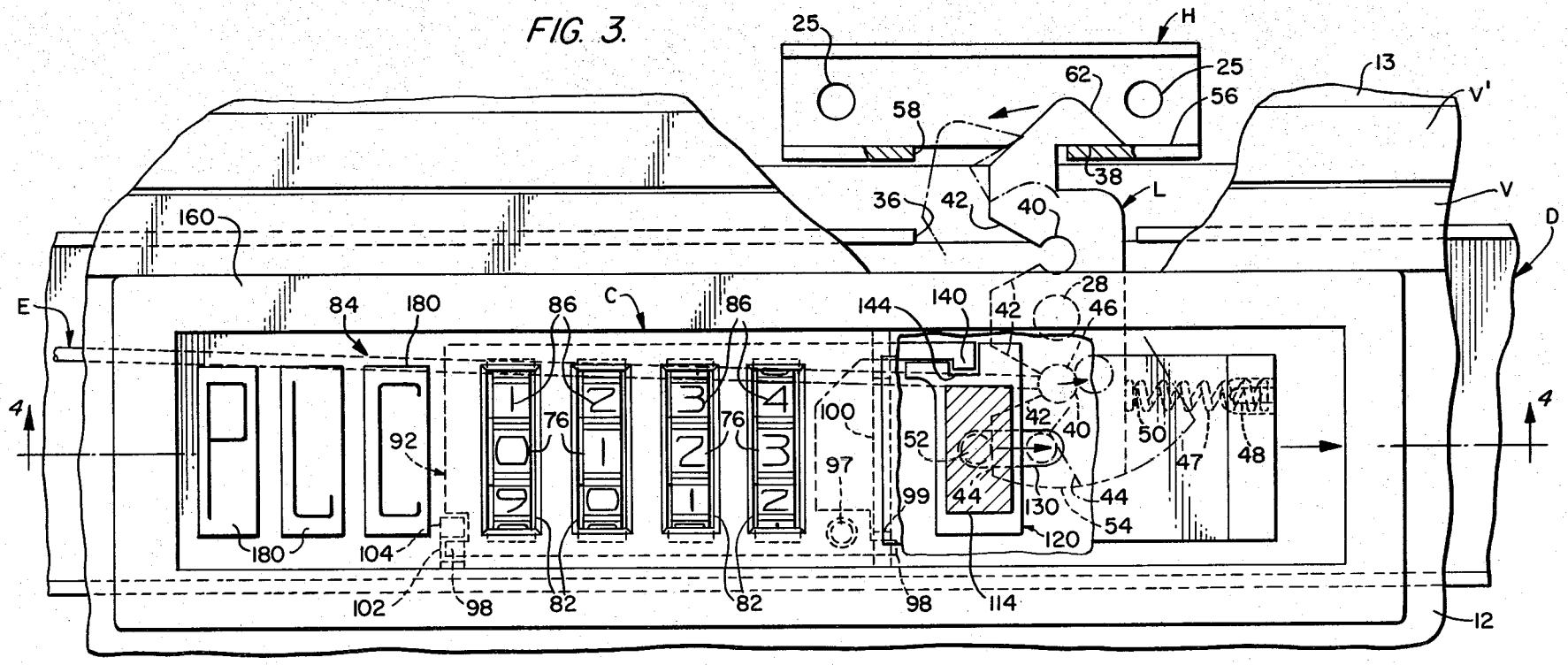
FIG. 3 is a top view partially broken away illustrating a portion of the latching assembly of FIG. 2.

When the actuator is moved to its open position (to the right in the figures as indicated by the arrows) projection 52 causes the right-hand latch to pivot counterclockwise to the phantom line position illustrated in FIG. 3, at which position the hook 38 of the latch is disengaged from the side wall 56 of the hasp H and is located within opening 58 of the hasp. This is the unlatching position of the latch. As the right-hand latch rotates to unlatching position, the left-hand latch executes a similar but opposite rotation, as previously described, to its unlatching position.

As the actuator moves to open position and the right-hand latch rotates to unlatching position, projection 52 slides along the side 44 of the latch, which constitutes a cam surface. When the latches rotate to their unlatching positions, the coil springs 47 are compressed between the sides of the latches and their respective locating tabs 48. When the actuator is released, the coil springs cause the latches to rotate back to their latching positions, and the actuator returns to its rest position. As shown in FIG. 4, a separate return spring 60 may also be provided for biasing the actuator to its rest position. This is desirable for reasons which will become apparent shortly.

Although the actuator must be operated to move the latches to unlatching position in order to open the case, it is not necessary to operate the actuator in order to close the case. As shown in FIGS. 2 and 3, the end of each latch adjacent to hook 38 is formed with a cam surface 62. When the parts of the case are brought together to close the case and the latches are in latching position, one side of the opening 58 in each hasp engages the cam surface 62 of its associated latch; this causes the latches to pivot to their unlatching positions so that the latches may enter the openings of the hasps. As the parts of the case come together in closed position, coil springs 47 cause the latches to pivot back to their latching positions, engaging the hooks with the hasps. Since actuator A is not attached to the right-hand latch, projection 52 merely engaging the side of the latch, the latches are able to move to unlatching position independently of the actuator during closing of the case. Coil spring 60 holds the actuator in its rest position and prevents undesirable movement or jiggling of the actuator during closing of the case.

As previously indicated, the latching assembly of the invention preferably incorporates a combination lock C for preventing the case from being opened except when the combination lock is on combination. Although various locking arrangements may be employed for this purpose, in the preferred form of the invention illustrated in the figures, the combination lock C is used to control the movement of the actuator and prevents movement of the actuator from its rest position except when the combination lock is on combination, thereby preventing movement of the latches to their unlatching positions and preventing the case from being opened. Preferably, combination lock C is a pivoted bolt combination lock of the type disclosed in U.S. Pat. No. 3,800,571 to Heine, issued Apr. 2, 1974, and assigned to the same assignee as the present invention, the disclosure of which is incorporated by reference herein. In the description which follows, only so much of the construction of the combination lock as is necessary for an understanding of the invention will be presented. Further details of the combination lock may be had by reference to the Heine patent.

As shown in the figures, the combination lock generally comprises a frame 70 supporting a longitudinally extending shaft 72 on which a plurality of sleeves 74 and combination dials 76 are rotatably mounted, each dial being coupled to an associated sleeve. A coil spring 78, located on one end of the shaft between the frame and an adjacent sleeve, biases the sleeves into abutting relationship against a collar 80 attached to the shaft and into coupled relationship with the dials. The combination dials 76 extend partially through slots 82 in a face plate 84 to centrally display in each slot an indicium 86 located on the periphery of each dial. As is well known, each sleeve 74 rotates with its associated dial 76 and has a circular flange 87 (see FIG. 5) with a flat portion 88. A dial spring 89 in the frame has a plurality of resilient arms 90 which enter notches 91 on the periphery of each dial between successive indicia 86 to hold each dial in a series of discrete rotational positions.

Figure 6:
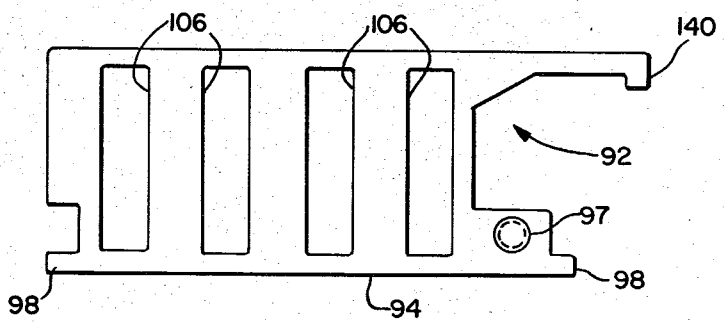
FIG. 6 is a plan view of a bolt useful in a combination lock which may be employed in the latching assembly of the invention.

A bolt 92, best illustrated in FIG. 6, is pivotally supported in the frame for rotation about an axis along one side 94 of the bolt and is biased into engagement with the sleeves by a spring 96 located between a projection 97 of the bolt and the frame, as shown in FIG. 5. The bolt may be supported in the frame by tabs 98 at opposite ends of side 94 of the bolt. As shown in FIGS. 3 and 5, the right-hand (in the figures) tab 98 may be received in a cutout 99 in an intermediate wall 100 of the frame, which also supports one end of shaft 72. The left-hand tab 98 of the bolt may similarly be received in an opening 102 in a bracket 104 on the frame, as shown in FIG. 3. The bolt has a plurality of slots 106 through which the dials 76 pass so that the bolt may be biased into engagement with the sleeves.

As shown in FIG. 5, when one or more of the dials is rotated off combination so that a portion of the circular flange 87 of its corresponding sleeve contacts the bolt, the bolt is pivoted downwardly to the dotted line position. This is the locked position of the bolt. When all of the dials are rotated to the on combination position so that the flat portions 88 of the sleeves are located adjacent to the bolt, the bolt pivots upwardly to the horizontal phantom line position of FIG. 5. This is the unlocked position of the bolt. When the bolt is in locked position, it engages actuator A (in a manner which will be explained shortly) to prevent movement of the actuator from its rest position.

As shown particularly in FIGS. 2 and 4, actuator A may comprise a generally planar operating member or button 110 having a finger-engaging portion 112 and a stepped block-shaped depending portion 114. The planar member 110 of the actuator slides on the faceplate 84 of the combination lock, and the stepped depending portion 114 serves to connect the actuator to the faceplate. As shown in FIGS. 2 and 4, the faceplate is formed with a generally rectangular slot 116 through which the depending portion 114 of the actuator extends. The width of slot 116 is selected such that when the actuator is assembled with the faceplate, the ledges 118 on opposite sides of the depending portion 114 abut the underside of the faceplate on opposite sides of slot 116, as illustrated in FIG. 5, to connect the actuator and the faceplate together. The length of slot 116 is selected to permit sufficient longitudinal sliding movement of the actuator to allow the latches to be moved to unlatching position. To assemble the actuator with the faceplate, the actuator may be rotated 90 degrees from the position illustrated in FIG. 2 to permit insertion of depending portion 114 into slot 116. The actuator may then be rotated back to the position illustrated in the figure to position ledges 118 adjacent to the underside of the faceplate.

Figure 7:
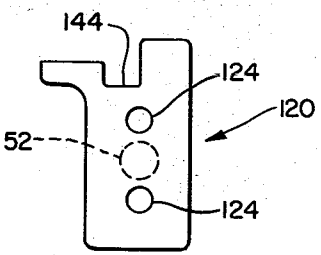
FIG. 7 is a plan view of a locking member which is cooperable with the bolt of FIG. 6 for locking an actuator of the latching assembly of the invention.

A locking member 120, best illustrated in FIGS. 2 and 7, is attached to the lower end of the depending portion 114 of the actuator. For this purpose, the depending portion 114 may be formed with studs 122 which extend through corresponding holes 124 in the locking member and have their ends swedged over to connect the locking member to the actuator. As shown in the figures, projection 52 of the actuator, which engages the right-hand latch L, may be formed as a depending projection on the locking member. When the parts are assembled, depending portion 114 of the actuator and locking member 120 are located within frame 70 of the combination lock between intermediate wall 100 and an end wall 128 of the frame, with projection 52 extending through a slotted opening 130 in the bottom of the frame. As shown in FIG. 4, the actuator return spring 60 may be located on a projection 132 formed on depending portion 114 and on a projection 134 formed on the end wall 128 of the frame.

Locking member 120 and bolt 92 cooperate to prevent movement of the actuator from its rest position in the following manner. As shown in FIGS. 3 and 6, bolt 92 has a hook portion 140 which extends through an opening 142 in intermediate wall 100 (FIG. 5) and is positioned to engage a notch 144 formed on an adjacent end of the locking member. When the combination lock is off combination and the bolt is in locked position, the hook portion 140 of the bolt enters notch 144 of locking member 120, as shown in FIG. 3, preventing movement of the actuator from its rest position. When the combination lock is on combination and the bolt pivots to its unlocked position (the phantom line position of FIG. 5), hook portion 140 of the bolt is positioned above notch 144 of the locking member, so that the actuator may be moved to open position.

Combination lock C may also incorporate means for changing the combination. As is well known, a shift lever 150 may be located on shaft 72 between collar 80 and intermediate wall 100 for moving the sleeves out of coupled relationship with their associated dials (to the left in FIG. 4) when the combination lock is on combination, to permit the dials to be rotated independently of the sleeves to a new combination. Openings 152 in the frame and 154 in the channel may be provided for access to the shift lever 150.

As shown in FIGS. 2 and 4, frame 70 and faceplate 84 of the combination lock may be assembled with a mounting plate 160 to form an integrated control panel assembly. The mounting plate may be formed with depending studs on its underside which extend through holes 162 in the ends of the frame and are swedged over, as shown at 164 in FIG. 4, to connect the frame to the mounting plate. The mounting plate is adapted to be positioned asymmetrically on the exterior surface of the body side wall 12 of the luggage case and may be connected to channel D by mounting posts 166 depending from the underside of the mounting plate for receiving threaded fasteners 168 extending through corresponding holes 170 in the channel. For symmetry of design, mounting plate 160 and faceplate 84 may have a length such that the combination dials 76 may be located at approximately the center of the faceplate with the actuator positioned on the faceplate on one side of the dials, and with a space on the opposite side of the dials in which may be affixed decorative plates 180 bearing the initials of the owner of the luggage case or some other appropriate design. The faceplate is preferably plastic with its underside hot stamped to provide color and contrast.

Latching assemblies in accordance with the invention have a number of significant advantages over known latching assemblies. For example, the latching mechanism of the invention comprising channel D, pivoted latches L, and their associated parts constitutes an assembly which is separate from the actuator-combination lock assembly. Since the actuator is not attached to the right-hand latch L (projection 52 simply abuts one side of the right-hand latch), it may be appreciated that the extent of the engagement between the actuator and the latch, i.e., the length of the portion of projection 52 which engages the side of the latch, is relatively unimportant as long as the engagement is sufficient to pivot the latch to unlatching position when the actuator moves to open position. Accordingly, the latching assembly can readily accommodate reasonably wide variations in the thicknesses of the side wall and the valance of the case, and, for example, may be used on an injection molded luggage case shell, a vacuum molded shell, a wood box or various other types of construction.

The latching assembly of the invention is relatively simple. It employs a relatively small number of parts, is easily assembled, and permits the operation of spaced latches with a single actuator. Since the actuator and the dials of the combination lock must be related to the exterior surface of the case, employing the combination lock to control the movement of the actuator rather than for directly controlling the movement of the latches also contributes to the simplicity of the assembly. Moreover, since the latching assembly of the invention employs spaced latches which pivot in opposite directions and which are statically balanced about their pivotal axes, the latches are relatively immune to being jarred open as a result of a shock applied to the case. Another significant advantage of the latching assembly of the invention is that it employs a so-called scramble feature, allowing the latches to be moved to unlatching positions independently of the actuator, so that the case may be closed when the combination lock is off combination.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. A latching assembly for luggage cases and the like comprising a pair of spaced pivoting latches adapted to be mounted on a first part of a luggage case adjacent to an edge thereof, the latches being movable between latching and unlatching positions and being cooperable with associated hasps on a second part of the case for holding the case closed when the parts are brought together and the latches are in latching position, an actuator adapted to be slideably mounted on the first part of the case for movement between a rest position and an open position, the actuator being associated with one of the latches for moving said one latch to unlatching position when the actuator moves to open position, and an elongated member extending between the latches so that the latches are constrained for concerted movement between latching and unlatching positions, the elongated member being connected to the latches on opposite sides of their respective pivotal axes so that the latches pivot in opposite directions.

2. The assembly of claim 1 further comprising a base adapted to extend along the edge of the first part of the case and to be attached thereto, the latches being mounted on the base and pivoting in the plane of the base.

3. The assembly of claim 1, wherein each latch has first and second portions which extend in opposite directions from the pivotal axis of the latch, the first portion having latching means for engaging the associated hasp.

4. The assembly of claim 3, wherein each of said portions has means adapted for connection to the elongated member.

5. The assembly of claim 1, wherein each latch is statically balanced about its pivotal axis.

6. The assembly of claim 1, wherein the latches are identical planar members.

7. A latching assembly for luggage cases and the like comprising a pair of spaced pivoting latches adapted to be mounted on a first part of a luggage case adjacent to an edge thereof, the latches being movable between latching and unlatching positions and being cooperable with associated hasps on a second part of the case for holding the case closed when the parts are brought together and the latches are in latching position, an actuator adapted to be slideably mounted on the first part of the case for movement between a rest position and an open position, the actuator being associated with one of the latches for moving said one latch to unlatching position when the actuator moves to open position, and an elongated member extending between the latches so that the latches are constrained for concerted movement between latching and unlatching positions, the elongated member having an enlargement on each end thereof, and wherein each latch has a recess sized to receive and to capture one of said enlargements, and an opening between one side of the latch and the recess, the opening being sized to pass the elongated member.

8. The assembly of claim 7, wherein the elongated member is located in the plane of the latches, and said opening is sector-shaped allowing the latches to pivot unobstructed by the elongated member.

9. The assembly of claim 7, wherein the elongated member is a flexible cable.

10. The assembly of claim 7, wherein the elongated member is a rod.

11. A latching assembly for luggage cases and the like comprising a pair of spaced pivoting latches adapted to be mounted on a first part of a luggage case adjacent to an edge thereof, the latches being movable between latching and unlatching positions and being cooperable with associated hasps on a second part of the case for holding the case closed when the parts are brought together and the latches are in latching position, an actuator adapted to be slideably mounted on the first part of the case for movement between a rest position and an open position, the actuator having means for engaging a cam surface of a first one of the latches for pivoting said one latch to unlatching position when the actuator moves to open position, and an elongated member extending between the latches so that the latches are constrained for concerted movement between latching and unlatching positions.

12. The assembly of claim 11, wherein the engaging means comprises a projection and said cam surface comprises a side of said first one of the latches.

13. A latching assembly for luggage cases and the like comprising a pair of spaced pivoting latches adapted to be mounted on a first part of a luggage case adjacent to an edge thereof, the latches being movable between latching and unlatching positions and being cooperable with associated hasps on a second part of the case for holding the case closed when the parts are brought together and the latches are in latching position, an actuator adapted to be slideably mounted on the first part of the case for movement between a rest position and an open position, the actuator being associated with one of the latches for moving said one latch to unlatching position when the actuator moves to open position, and an elongated member extending between the latches so that the latches are constrained for concerted movement between latching and unlatching positions, each latch having cam means cooperable with the associated hasp for moving the latch to unlatching position independently of the actuator when the parts of the case are brought together.

14. The assembly of claim 13 further comprising locking means for locking the actuator in its rest position.

15. The assembly of claim 14, wherein the locking means comprises a combination lock, and wherein the actuator is part of the combination lock.

16. The assembly of claim 13 further comprising spring means for biasing the latches toward latching position.

17. The assembly of claim 13 further comprising spring means for biasing the actuator toward its rest position.

18. The assembly of claim 13, wherein the latches are mounted on an interior surface of a first part of a luggage case adjacent to the edge thereof, and the actuator is mounted on the exterior surface of the first part of the luggage case and is slideable parallel to said edge.

19. A latching assembly for luggage cases and the like comprising latch means adapted to be pivotally mounted on a first part of a luggage case adjacent to an edge thereof, the latch means being movable between latching and unlatching positions and being cooperable with associated hasp means on a second part of the case to hold the case closed, combination lock means adapted to be mounted on the first part of the case, the combination lock means having a slideable actuator movable from a rest position to an open position when the combination lock means is on combination and being prevented from such movement when the combination lock means is off combination, the actuator having means for engaging the latch means to pivot the latch means to unlatching position when the actuator moves to open position.

20. The assembly of claim 19, wherein the actuator slides parallel to said edge.

21. The assembly of claim 19, wherein the latch means is oriented to pivot in a plane parallel to a plane containing the first part of the luggage case and the edge.

22. The assembly of claim 19, wherein the latch means comprises a pair of spaced latches having means extending therebetween for constraining the latches for concerted movement between latching and unlatching positions, and wherein the engaging means of the actuator comprises a projection engaging a cam surface of a first one of the latches.

23. The assembly of claim 22, wherein the extending means is connected to the latches such that the latches pivot in opposite directions.

24. The assembly of claim 22, wherein each latch is statically balanced about its pivotal axis.

25. The assembly of claim 19, wherein the latch means and the associated hasp means have cooperable means for moving the latch means to unlatching position independently of the actuator when the parts of the case are brought together.

26. A latching assembly for luggage cases and the like comprising latch means pivotally mounted on a first part of a luggage case for movement between latching and unlatching positions, hasp means mounted on a second part of the luggage case and being cooperable with the latch means for holding the case closed, the latch means and the hasp means being mounted interiorly of the case so that they are hidden from view when the case is closed, a control panel mounted asymmetrically on the exterior of the luggage case, the control panel including a slideable actuator movable between a rest position and an open position and a combination lock for controlling the movement of the actuator, and means interior of the case for moving the latch means to unlatching position when the actuator moves to open position.

27. The latch assembly of claim 26, wherein the luggage case includes a centrally located carrying handle, and wherein the control panel is mounted on one side of the handle and adjacent to an end of the case.

28. For use in a latching assembly of the type having a pivoted latch mounted on a first part of a luggage case for movement between latching and unlatching positions and being cooperable with an associated hasp on a second part of the luggage case for holding the case closed, a latch comprising a generally planar elongated member having means for pivotally mounting the member on a luggage case for rotation about an axis substantially perpendicular to the plane of the member, the member having first and second portions extending in opposite directions from said pivoting means with a recess located within each of said portions between the pivoting means and an end of the member, each recess being connected to one side of the member by an opening, and a hook element formed near the end of the first portion of the member for engaging an associated hasp.

29. The latch of claim 28, wherein the hook element lies in the plane of the member and faces the opposite side of the member from the openings.

30. The latch of claim 28, wherein the openings are sector shaped.

31. The latch of claim 28, wherein the pivoting means is located at approximately the midpoint of the member and is positioned so that the member is statically balanced about its pivotal axis.

32. The latch of claim 28, wherein the member is formed of plastic.

* * * * *